US005526902A

United States Patent [19]

Gausachs et al.

[11] Patent Number: 5,526,902

[45] Date of Patent: Jun. 18, 1996

[54] SAFETY DEVICE FOR LIFTS STOPPED BETWEEN FLOORS

[76] Inventors: Miguel Gausachs, Virrey Cevallos 705, (1077) Buenos Aires; Roberto T. Borsa, Av. Independencia 1851, 3er. piso "A", (1225) Buenos Aires; Jorge Segal, Suipacha 642, (1108) Buenos Aires, all of Argentina

[21] Appl. No.: 299,745

[22] Filed: Sep. 1, 1994

[30] Foreign Application Priority Data

Sep. 1, 1993 [AR] Argentina ..... 325879

[51] Int. Cl.[6] ..... B66B 11/08

[52] U.S. Cl. ..... 187/263; 187/291

[58] Field of Search ..... 187/263, 290, 187/291, 350, 288

[56] References Cited

U.S. PATENT DOCUMENTS 4,592,450 6/1986 Schaffer ..... 187/263

FOREIGN PATENT DOCUMENTS 2033080 2/1990 Japan ..... 187/263

2270792 11/1990 Japan ..... 187/263

*Primary Examiner*—Kenneth Noland

*Attorney, Agent, or Firm*—Lucas & Just

[57] ABSTRACT

The invention comprises an autonomous power source and damper, a manual command in the lift cabin, a coupler for coupling the safety device to the shaft of the lift equipment, a displacement speed self-regulating device for the lift cabin, a limiting device for levelling the lift cabin to the floor and cycle end with brake blocking and deactivation of the safety device.

2 Claims, 1 Drawing Sheet

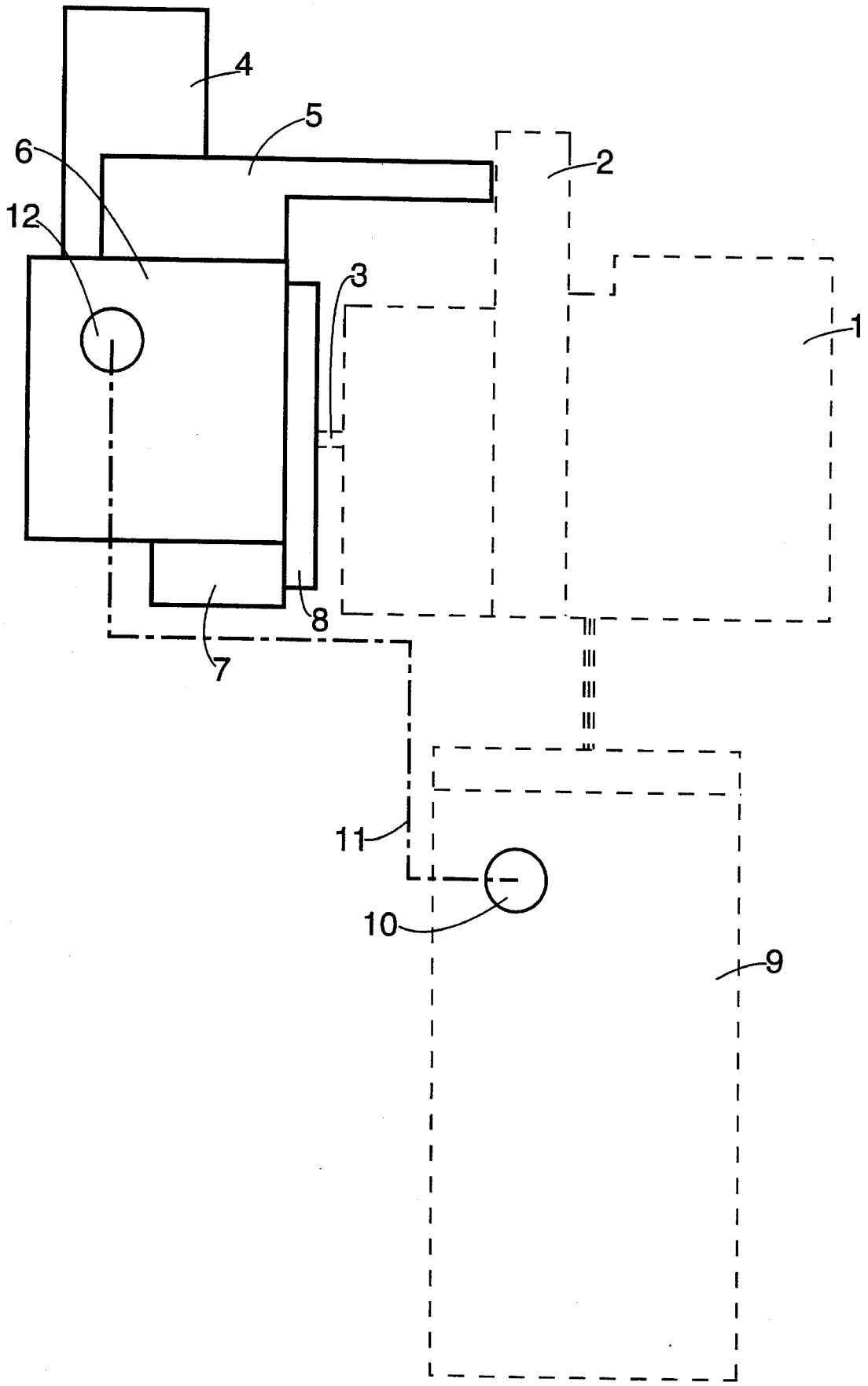
4
5
6
2
12
3
1
8
7
11
10
9

SAFETY DEVICE FOR LIFTS STOPPED BETWEEN FLOORS

FIELD OF THE INVENTION

The instant invention relates to a safety device for lifts stopped between floors.

BACKGROUND OF THE INVENTION-PRIOR ART

Essentially, the invention comprises an autonomous power source and damper, a manual command at the lift cabin, a coupler for coupling the safety device to the driving shaft of the lift equipment, a displacement speed self-regulating device for the lift, a limiting device for levelling the lift cabin floor and end of cycle with brake blocking and deactivation of the safety device.

The invention is used in lifts in general, and particularly in lifts carrying passengers; the object being the rescue of the persons involved (or the lift cabin per se) trapped between floors due to any circumstance (power shortage, damages in the lift system, fires, accidents, etc).

At present, no device to this end is known in the art.

In fact, during this year, a terrorist act at the center of New York (which was world known due to its magnitude) caused, among other things, the detention of almost all lifts in the building and the persons trapped therein could not be rescued, since there was no safety device to carry the stopped lifts to the immediate floor.

In our country, there is an average of fourteen deaths per year due to lift accidents and there are also hundreds of cases per day in which persons are trapped within a lift between floors (mainly due to power shortages) for a fairly long time until they are located and rescued (constituting a true nightmare for claustrophobic or sick people).

The major inconvenience in solving this problem is the variety of different lifts existing in the market, each having a particular driving system. Further, the same line or mark has several lift types and within these types, models vary according to their antiquity.

SUMMARY OF THE INVENTION

However, on the basis of thorough research and tests, a device was developed which, acting on the conventional brake of the lift, overcomes the problem satisfactorily, in turn being adaptable to most of the types and models of lifts at present in use.

The main advantage of the device of the invention is that, by means of a command located within the lift, duly marked "safety use" or the like, it allows the passenger to drive the autonomous acting of the lift stopped between floors, thus carrying the lift towards the immediate floor, where it will stop, allowing the passengers to exit.

Another advantage of the invention is that the device may be readily mounted in the machinery room of the lift and allows, by means of finishing details upon mounting, adapting the device to any kind of lifts.

Still a further advantage of the device of the invention is blocking of the lift once it has reached the limit of its autonomous driving, in turn deactivating the lift driving mechanism, such that if due for any reason, the driving mechanism is activated, there is no risk of an accident (for example, upon power shortage when power is resumed).

Therefore, an object of the invention is a device with self-contained power, which may be coupled to the driving shaft in order to debrake it gradually and under control, for moving the lift to the immediate floor (lower or upper floor according to the mode of the lift and its counterweights), blocking the lift in said floor and deactivating the driving mechanism of the lift.

A preferred embodiment of the invention will be hereinbelow described, to which users and those skilled in the art may introduce any modification, in connection with the accompanying drawing.

BRIEF DESCRIPTION OF THE DRAWING

The single drawing of this application represents, with thin and dotted lines, the devices corresponding to the lift, and with full and thick lines, the device of the invention. The line representing the connection of the manual command to the safety device of the invention is a dash and dotted line.

DETAILED DESCRIPTION OF THE INVENTION

Conventionally, lifts are provided with a lifting device 1 to which a brake 2 of said lifting device is engaged. The brake 2 may be connected to the lifting device 1, according to the model or type, to the right, to the left, or, as in the example herein, at the center.

The driving shaft 3 also is a part of the conventional lifting device 1.

The device of the invention comprises an autonomous power source 4 which feeds a regulating transmission 5 for brake 2.

This brake regulating transmission 5 is self-regulated by a centrifugal self-regulator which in turn commands an automatic coupling 7.

The automatic coupling 7 is connected to a transmission device 8 of the conventional driving shaft 3 of the lifting device 1.

In order to actuate the device of the invention, a manual command 10 is located inside the lift cabin 9, connected by a line 11 to the automous power source 4.

Further, a direct manual command 12 is located at the machinery room of the lift, installed in the device of the invention. This direct manual command 12 is important for levelling the lift to the immediate floor in cases in which the passenger may not level it or merely when the cabin 9 of the lift is empty, particularly, in the case of a lift for materials loading.

In practice, the manual command 10 of cabin 9 will be mounted in a way permitting ready and safe operation of the safety device.

Operation of the device of the invention begins when, due to any damage (such as power shortage) cabin 9 of the lift stops between floors. When this situation takes place, the passenger actuates the manual command 10 thus operating the cycle.

The autonomous power source 4 energizes the regulating transmission 5 of the brake 2, connected by the manual command 10 or, in the case of a cabin without passengers, by the direct manual command 12.

Once the lift is debraked, the centrifugal self-regulator 6 regulates the lift movement through the automatic coupler 7 which couples or uncouples transmission 8 with relation to the driving shaft 3.

Constructive and functional advantages of the invention are apparent from the above, the scope of the invention being only limited by the spirit of the appended claims.

We claim:

1. Safety device for lifts stopped between floors, the lift being of conventional type provided with a lifting device, to which a brake is connected, the brake being also connectable to a lifting device of the driving shaft of the lift forming part of the conventional lifting device, characterized by an autonomous power source feeding a brake regulating transmission, said brake regulating transmission being self-regulated by a centrifugal self-regulator which in turn commands an automatic coupling; said automatic coupling being connected to a transmission device of the conventional driving shaft of the lifting device; a manual command being located in the lift cabin connected by a line to the autonomous power source; said manual command being operative to move the lift to an immediately adjacent floor in an emergency.

2. Safety device for lifts stopped between floors, as claimed in claim 1, wherein the lift brake regulating transmission is regulated by a centrifugal self-regulator.

* * * * *